US006634706B2

(12) United States Patent
May

(10) Patent No.: US 6,634,706 B2
(45) Date of Patent: Oct. 21, 2003

(54) ROCKING RECLINER CHAIR

(75) Inventor: Teddy J. May, Mooreville, MS (US)

(73) Assignee: Lane Furniture Industries, Inc., Tupelo, MS (US)

( * ) Notice: Subject to any disclaimer, the term of this patent is extended or adjusted under 35 U.S.C. 154(b) by 124 days.

(21) Appl. No.: 09/963,496

(22) Filed: Sep. 27, 2001

(65) Prior Publication Data

US 2003/0057743 A1 Mar. 27, 2003

(51) Int. Cl.[7] ..... A47C 1/024

(52) U.S. Cl. ..... 297/85; 297/DIG. 7; 297/270.1; 297/270.2; 297/270.3

(58) Field of Search ..... 297/85, 270.1, 297/270.2, 270.4, DIG. 7, 270.3

(56) References Cited

U.S. PATENT DOCUMENTS

| | | | | |
|---|---|---|---|---|
| 3,302,969 A | | 2/1967 | Mizelle et al. | 297/85 |
| 3,339,971 A | | 9/1967 | Fletcher | 297/85 |
| 3,464,736 A | | 9/1969 | Mizelle | 297/84 |
| 3,622,198 A | | 11/1971 | Re | 297/DIG. 7 |
| 3,638,995 A | | 2/1972 | Flanagan et al. | 297/85 |
| 3,697,132 A | | 10/1972 | Van Surksum | 297/269.1 |
| 3,767,257 A | * | 10/1973 | Rogers, Jr. et al. | 297/85 |
| 3,768,859 A | * | 10/1973 | Rogers, Jr. et al. | 297/85 |
| 3,802,735 A | | 4/1974 | Re | 297/85 |
| 3,904,240 A | * | 9/1975 | Rogers, Jr. et al. | 297/85 |
| 4,319,780 A | | 3/1982 | Rogers, Jr. | 297/85 X |
| 4,601,513 A | | 7/1986 | Pine | 297/85 X |
| 4,674,794 A | | 6/1987 | Pine | 297/85 |
| 4,707,025 A | | 11/1987 | Rogers, Jr. | 297/85 X |
| 4,904,019 A | | 2/1990 | May | 297/85 |
| 5,121,967 A | | 6/1992 | Rogers | 297/DIG. 7 X |
| 5,480,209 A | | 1/1996 | May | 297/85 |
| 5,704,686 A | | 1/1998 | May | 297/85 X |
| 5,800,010 A | | 9/1998 | May | 297/85 |
| 6,000,754 A | | 12/1999 | Lawson | 297/85 |
| 6,142,558 A | | 11/2000 | May | 297/85 X |
| 6,231,120 B1 | * | 5/2001 | Wiecek | 297/DIG. 7 X |
| 6,309,015 B1 | * | 10/2001 | Pine | 297/85 |

* cited by examiner

*Primary Examiner*—Rodney B. White
(74) *Attorney, Agent, or Firm*—Pillsbury Winthrop LLP; Intellectual Property Group

(57) ABSTRACT

A mechanism for a rocking reclining chair is caused to have enhanced ease of use, to be more stable, and to provide enhance comfort. The mechanism includes a locking linkage arranged to engage the base of the chair for locking of the claim against rocking when the ottoman of the chair is extended. The locking linkage preferably includes two locking members arranged to make locking engagement with the base of the claims at locations rearward of the locations where the chair's rocker cams are supported.

21 Claims, 15 Drawing Sheets

ROCKING RECLINER CHAIR

BACKGROUND OF THE INVENTION

The present invention relates to a rocking reclining chair and a mechanism therefor, and especially to a rocking reclining chair and mechanism which provides increased stability to a user, particularly when the ottoman of the chair is extended, and which provides an increased angle of pitch for the extended ottoman, provides ease of operation, and can be used for many different configurations of upholstery.

Rocking reclining chairs are typically constructed to provide a locking mechanism to prevent rocking of the chair when the chair's ottoman (also known as leg rest or footrest) is extended. Such locking mechanisms provides stability to the chair, since the user will typically have his or her feet off the floor when the ottoman is in the extended position, and rocking of the chair under these circumstances may result in discomfort to the user. Typical examples of prior art rocking reclining chairs having such rocking mechanisms are shown in U.S. Pat. Nos. 6,000,745 and 4,601,513.

However, prior art arrangements have not heretofore permitted the extended ottoman to be positioned at an increased pitch (or angle from the horizontal) so as to provide increased comfort for the user, and a need exists for a mechanism for a rocking reclining chair that will provide such an increased pitch for the ottoman. There is also a need for a rocking reclining chair having a locking mechanism that will provide enhanced ease of operation for the user so that the ottoman may be extended and the chair's position locked without undue effort. In addition, a need exists for a rocking reclining chair having a mechanism that is adaptable for use with many different configurations of upholstery, even if the various upholstery configurations have different balance points or weight characteristics. There is also a need for rocking reclining chair having a mechanism that is biased to prevent undue noise during rocking.

SUMMARY OF THE INVENTION

A mechanism for a reclining chair is caused to provide increased pitch, ease of operation, and enhanced comfort for the user, by having a locking linkage to lock the chair against rocking motion when the ottoman of the chair is extended. The locking linkage preferably includes two locking members, each engaging the base of the chair rearward of the locations where the chair's rocker cams are supported. The mechanism preferably includes a biasing link to bias the locking linkage against undesired movement when the ottoman is retracted.

The principles of the invention will be further discussed with reference to the drawings wherein preferred embodiments are shown. The specifics illustrated in the drawings are intended to exemplify, rather than limit, aspects of the invention as defined in the claims.

The terms "left" and "right" as used to describe the sides of the mechanism or chair are used from viewpoint of a person occupying the chair. The "handle side" in the preferred embodiment is the right side of the chair. The term "inboard side" of a side linkage refers to the side viewed looking outwards from medially of the chair, and term "outboard side" of a side linkage refers to the side viewed looking from outside towards the side mechanism.

In this description, the term longitudinal is used to denote the front-to-rear direction, and the term transverse is used to denote the left-to-right direction.

DETAILED DESCRIPTION OF PREFERED EMBODIMENTS

Figure 1:
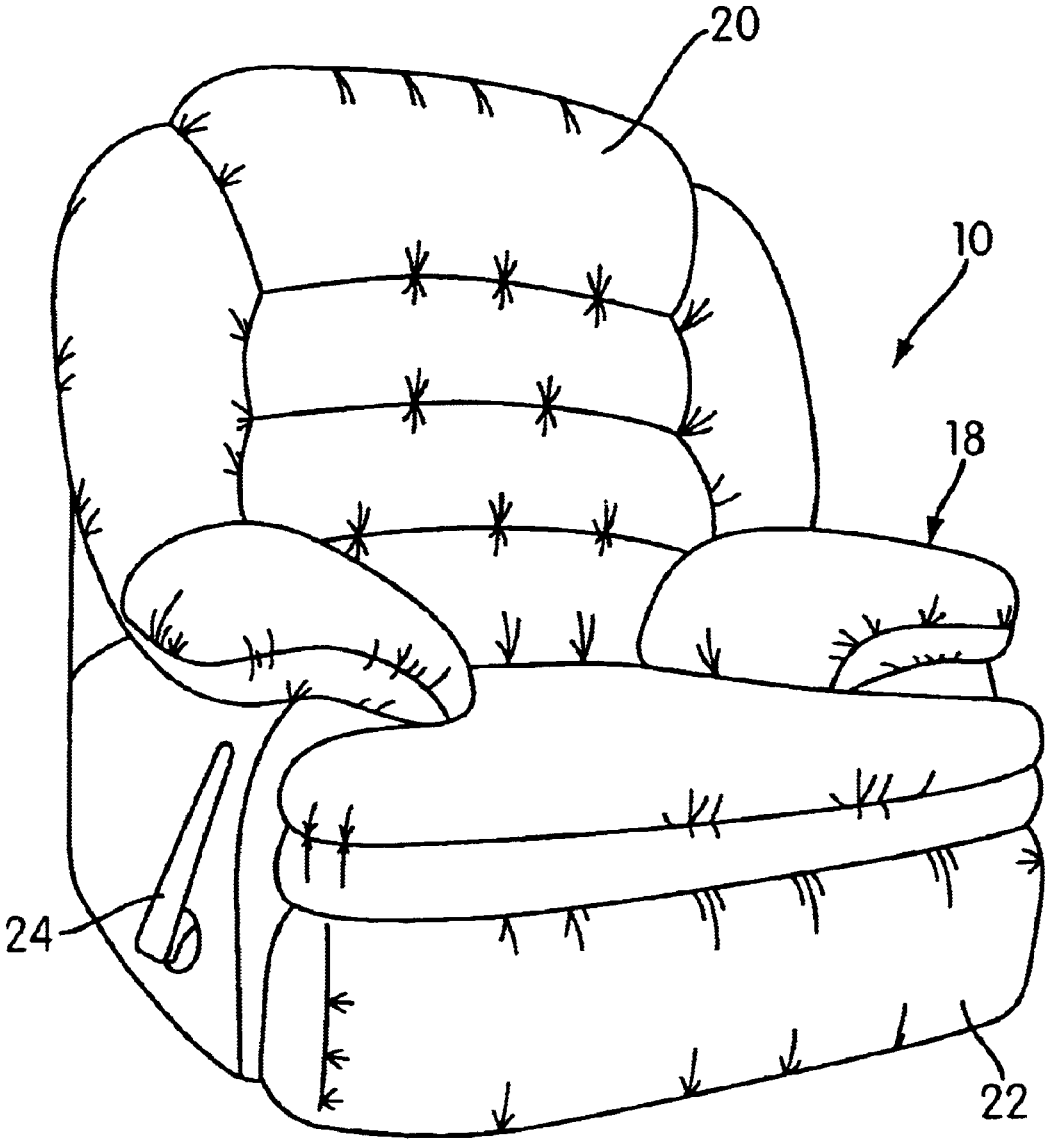
FIG. 1 is a perspective view of a rocking reclining chair embodying the principles of the present invention.

The chair 10 (FIG. 1) includes a base 12 (FIG. 2), a rocking reclining chair mechanism 14, a seat and arm frame mounting bracket 16, an upholstered seat and arm frame unit 18, an upholstered back 20 and an upholstered ottoman 22 (the primary member only of which shows in FIG. 1, the secondary member of which being stored therebehind in this position of the chair. (Ottomans are sometimes also known as leg rests or footrests.) In this embodiment, the operating mechanism is handle operated, at least for initiation of movement from the FIG. 2 to the FIG. 5 positions, the user-accessible operating handle being shown at 24 in FIG. 1 mounted on an end of a handle tube (to be described below, sometimes also known as a torque tube).

It is a convenient and conventional technique in the manufacture of reclining chairs, which is useful in manufacturing the chair 10, to provide the left and right sides of the base 12 and operating mechanism 14 (and, in this instance, the bracket 16) as corresponding elements of prefabricated mirror image (left and right) sub-assemblies often known as side linkages, certain corresponding elements of which are integrated by being interconnected by transverse interconnecting elements.

In this description, the term longitudinal is used to denote the front-to-rear direction, and the term transverse being used to denote the left-to-right direction).

In a handle-operated motion chair, such as the preferred embodiment of the chair 10, the operating handle 24 is mounted on an extension 26 (through an opening through the upholstery of the seat and arm frame unit 18) of a transversely extending torque tube 28, opposite end portions are journaled in sleeve bearings 30, e.g., made of nylon or other self-lubricated synthetic plastic material, mounted in openings in respective links of the left and right side linkages.

In view of the mirror image nature of the left and right side linkages, only one is shown in FIGS. 2–10.

In the preferred embodiment, the base 12 is shown comprising left and right longitudinal members 32, each provided as a steel square sectioned element laterally interconnected by transverse members 4, 6 each provided on an L-sectioned element having a lower, horizontal flange 38, and having an upstanding foremost flange 40 in the case front transverse member 34, and having an upstanding rearmost flange 42 in the case of the rear transverse member 36. The transverse members 32 are preferably welded to the members 34 and 38 where they cross.

Lower spring mounting blocks 44 are mounted on the transverse members 32 on the left and right sides thereof. The lower spring mounting blocks 44 are attached to the transverse members 32 by nut and bolt sets 46, or other appropriate fastening method. A pair of springs 48 have their lower ends mounted and lower spring mounting blocks 44, and the upper ends of the springs 48 are mounted in upper spring mounting blocks 50. The respective upper and lower ends of the springs 48 are held in the mounting blocks 44, 50 in corresponding recesses into which the helical springs 48 are threaded and securely gripped. The upper spring mounting blocks 50 are attached by nut and bolt sets 52, or other appropriate fastening means, to right and left cam mounting plates 54. The right and left cam mounting plates 54 are joined to each other by three transverse members, rear transverse member 56, and the preferred embodiment steel bar, intermediate transverse member 58, preferably a square steel tube section, and forward transverse member 60, preferably a square steel tube section.

Each of the cam mounting plates 54 is mounted on a respective rocker cam by screws or other appropriate fasteners. The left and right rocker cams 62 are made of solid hardwood or other appropriate material. The lower curved surface of each of the rocker cams 62 bears on the top surface of the respective left and right longitudinal base member 32 at location 63. When the chair 10 is in its upright position, as will be explained presently, the chair 10 is free to rock forwardly and rearwardly on the lower curved surfaces of the rocker cams 62. The springs 48 serve to damp the rocking motion produced thereby, and also provide a resilient "bounce" to assist the user in continuing the rocking motion. The springs 48, which is described above are securely held in the spring mounting blocks 44, 50, also maintain the rocker cams 62 in the desired transverse position atop the left and right longitudinal base members 32.

A support plate 64 is mounted atop each of the rocker cams 62 on the cam mounting plates 54. Each support plate 64 is attached to one of the cam mounting plates 54 by three steel pins or other appropriate fastening method.

The seat and arm frame mounting bracket 16 includes left and right longitudinal members 66, each provided as an L-sectioned element. The longitudinal members 66 of the bracket 16 are laterally interconnected at the front and rear by transverse members 68 and 70, each provided as an L-sectioned element having an upper flange 72 in the seating plane, and having a depending flange 74. The rear transverse member 70 may extend outboard of the longitudinal members 66 at each rear corner, in order to provide cantilevered sides for mounting correspondingly wide portions of the seat and arm frame unit 18 on the bracket 16. Interconnections of the bracket can be provided by nut and bolt sets installed through respective flanges where these cross.

Each side linkage of the mechanism 14 includes a seat mounting plate 76 which is longitudinally elongated, disposed in a respective vertical plane, and is generally concave upwards as seen inside elevation. Each seat mounting plate 76 is fixed near its front and rear, top end, on the outboard sides of the vertical flanges 67 of the longitudinal members 66 of the bracket 16. The seat mounting plates 76 therefor can be constructed to be integral with the respective longitudinal members 66.

The aforementioned sleeve bearings 29 are provided in openings provided transversely through the seat mounting plates 76 intermediate the front and rear ends of the plates 76, below the longitudinal members 66 of the bracket 16.

A transverse member 78, provided as a square-sectioned steel tube, is bolted at its opposite ends to respective tabs (not shown) formed on each seat mounting plates 76. The transverse member 78 is offset downwards between the longitudinal members 66 so as to avoid interfering with downward travel of the upholstered seat as a user sits down in a chair 10.

As is conventional, the ottoman is mounted on left and right pantograph linkage sets which form respective parts of the left and right side linkages. Each of these is shown including forward, middle and rear first links 80, 82 and 84, and forward, middle and rear second links 86, 88 and 90.

Describing one side, the upper, forward ends of the links 80 and 82 are connected by transverse, horizontal axis pivot joints 92, 94 to the vertical, longitudinal flange 96 of a primary ottoman mounting bracket 98, which also has a medially directed flange 100, to which a respective lateral end of the primary ottoman 22 is bolted.

A medially directed flange 102 is bent from the upper end of the link 86, to which a respective end of a secondary ottoman (not shown) is bolted.

The link 86 is connected by upper, middle and lower transverse, horizontal axis pivot joints 103, 104 and 106, respectively to the upper end of link 84, an intermediate site on link 82 and the lower end of link 80.

The link 88 is connected by upper, middle and lower transverse, horizontal axis pivot joints 108, 110 and 112, respectively to the seat mounting plate 76 above and forwardly of the transverse member 78, an intermediate site on link 84 and the lower end of link 82.

The link 90 is connected by upper and lower transverse, horizontal axis pivot joints 114, 116, respectively to the seat mounting plate 76 below and rearwardly of the transverse member 78, and the lower end of link 84.

Outboard of the set mounting plate 76, the left and right side linkages have respective crank links 118 bolted onto the torque tube 28 so as to each project radially from the torque tube in a respective vertical plane. Near its radially outer end, each crank link 118 is connected by a transverse, horizontal axis pivot joint 120 to the rear, lower end of a respective driving link 122, the forward end of which is connected by a transverse, horizontal axis pivot joint 124 to an intermediate site on the respective pantograph link 90.

Accordingly, rotating the operating handle 24 over top dead center to the rear causes the pantographic linkages to extend the ottoman and secondary ottoman from the stowed position shown in FIGS. 1, 2, 3, and 4 to the raised and extended position shown in FIGS. 4–10.

Reverting to single-side description, engagement of a laterally outwardly projecting pin 126, provided on the outside of the link 88 at an intermediate location, with the upper, rear side edge at a lower-intermediate site 128 on the link 84 stops extension of the pantographic linkage sets.

Conversely, a pin (not shown) may be provided on the seat mounting plate 76 to engage a site on the crank link 118 to stop retraction of the pantographic linkage sets.

A tension coil spring 130 is stretched between and hooked at opposite ends to an eye 132 provided on the transverse member 58, outboard of the main plate 60, and an eye 134 fixed on the torque tube 28, to become less stretched with extension of the pantographic linkage set, and more stretched with retraction of the pantographic linkage set, for assisting in preventing forward drooping of the ottoman and mechanism when the chair is in its FIGS. 1–4, fully upright position.

Figure 5:
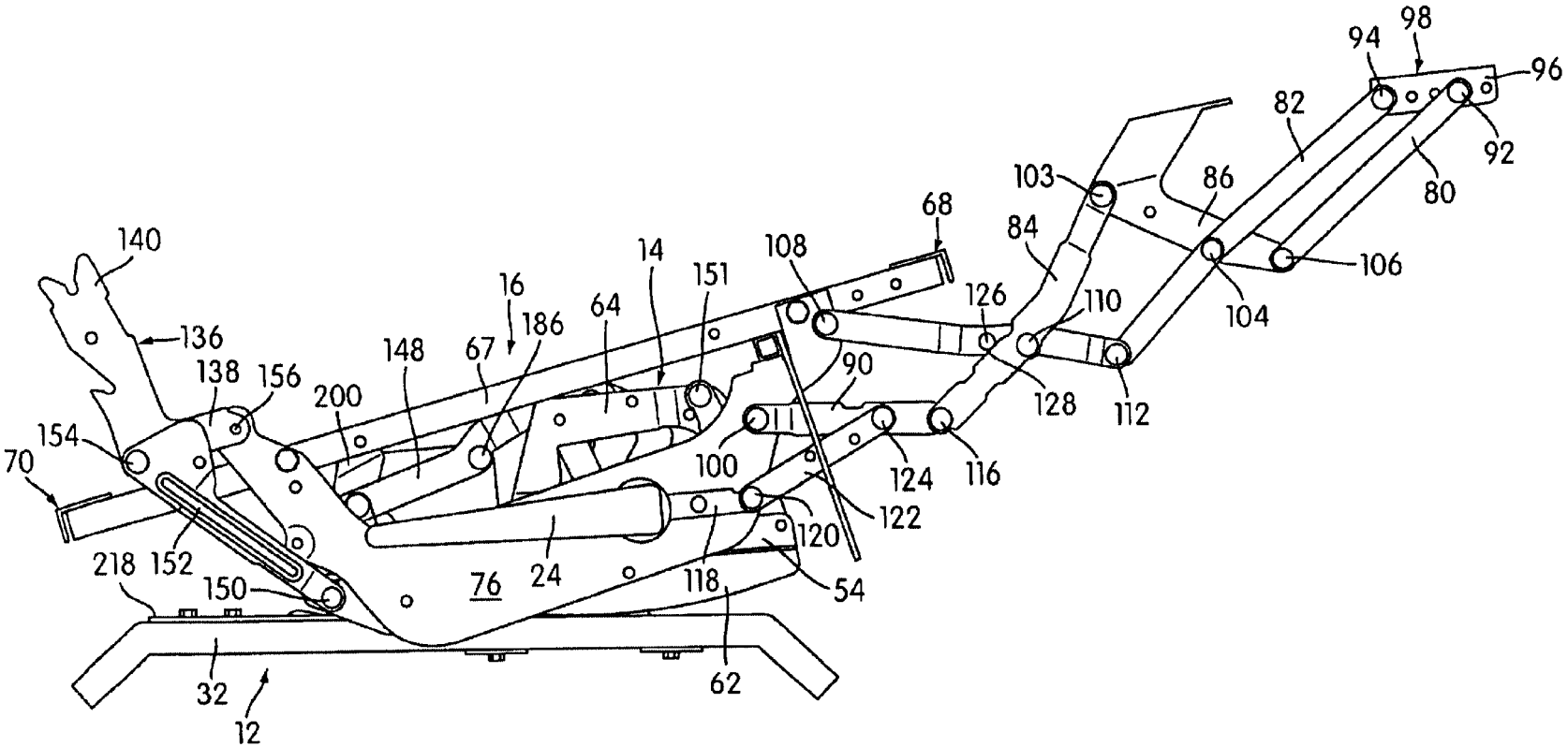
FIG. 5 is a side elevational view of the mechanism, shown in the intermediate, TV position thereof.
Figure 6:
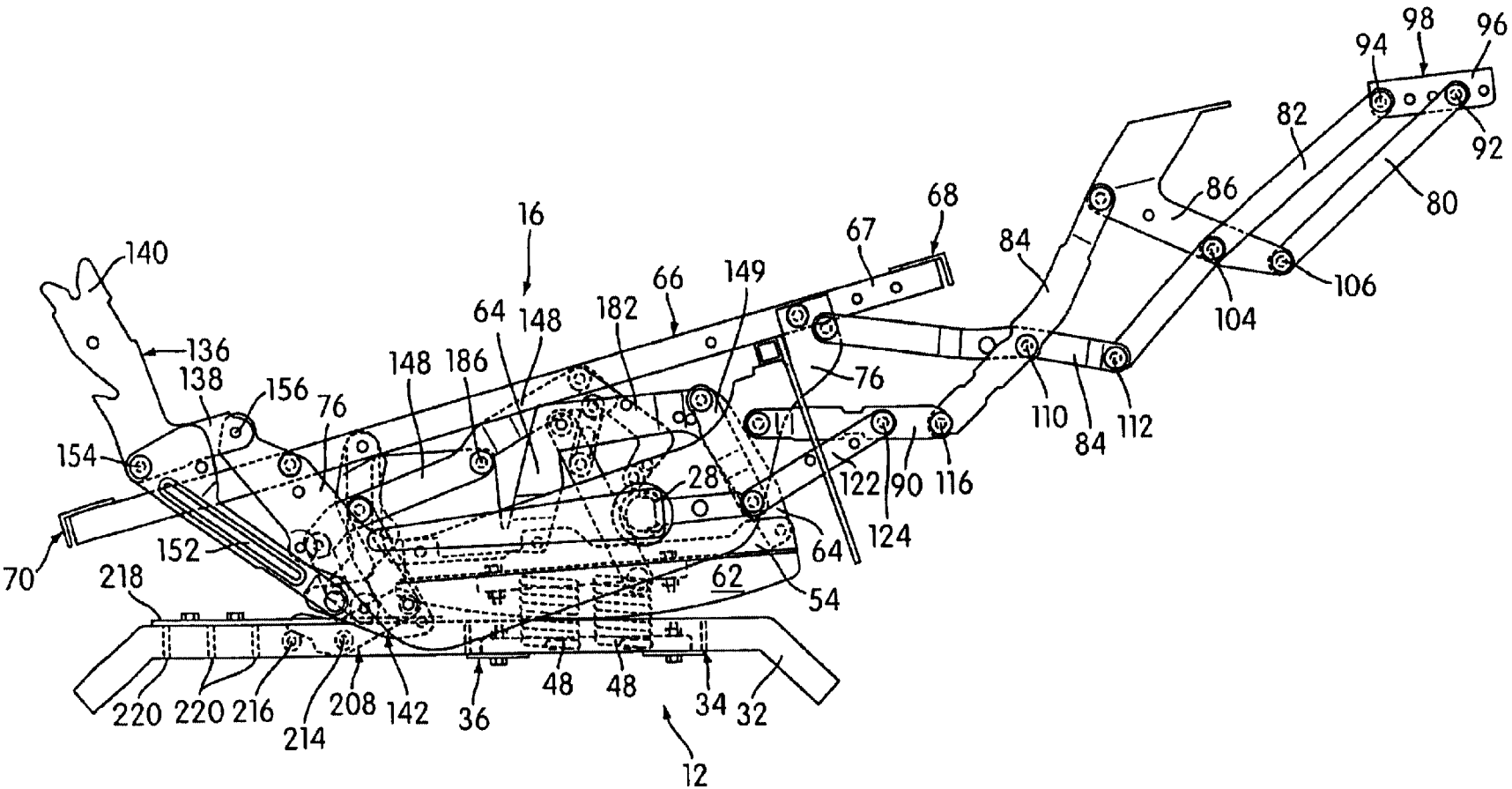
FIG. 6 is a comparable side elevational view of the mechanism in the position of FIG. 5, showing more of the mechanism.
Figure 7:
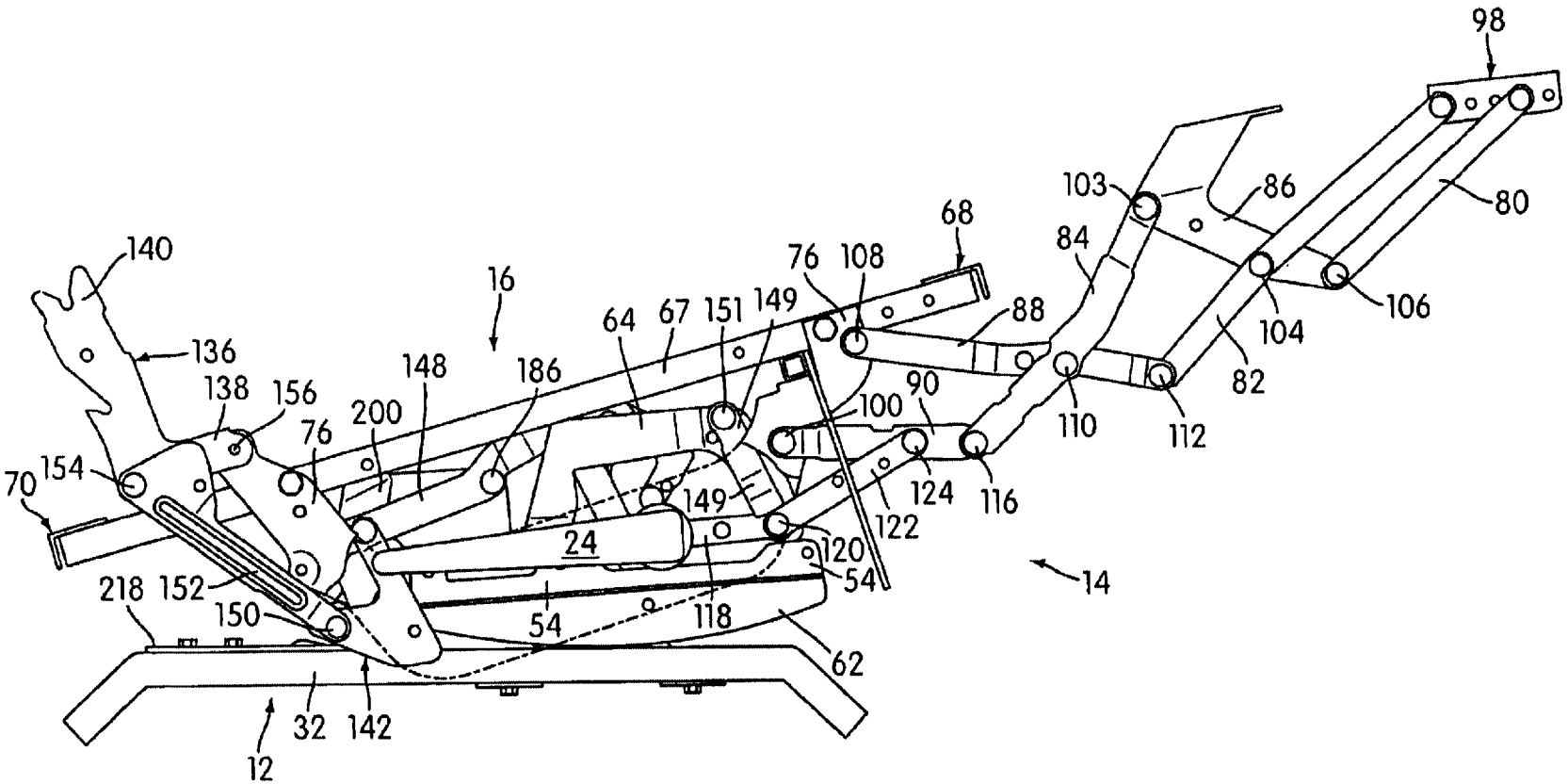
FIG. 7 is a comparable side elevational view of the mechanism in the position of FIG. 5, with the seat mounting plate partially cut away.
Figure 8:
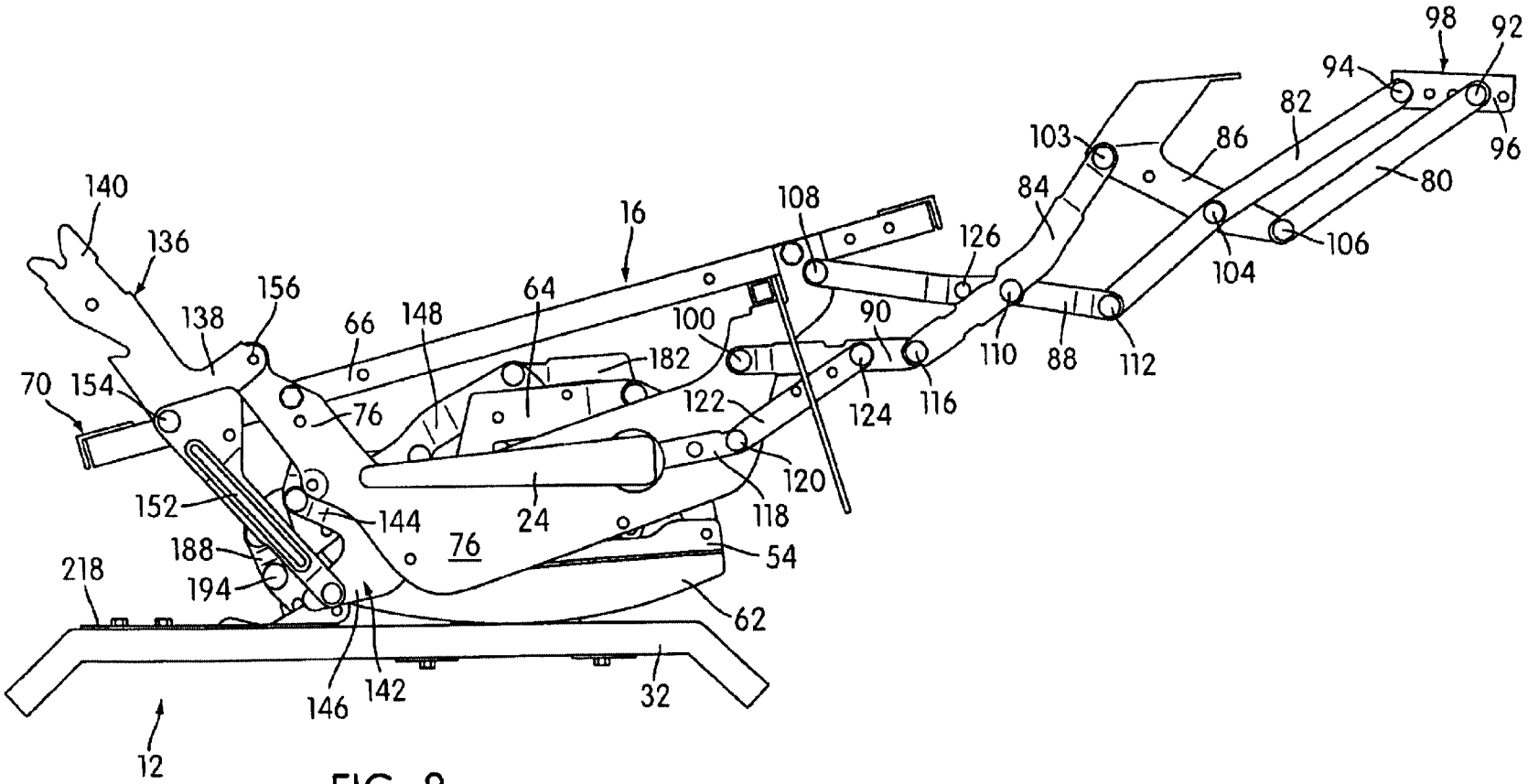
FIG. 8 is a comparable side elevational view of mechanism, shown in the fully reclined position thereof.
Figure 9:
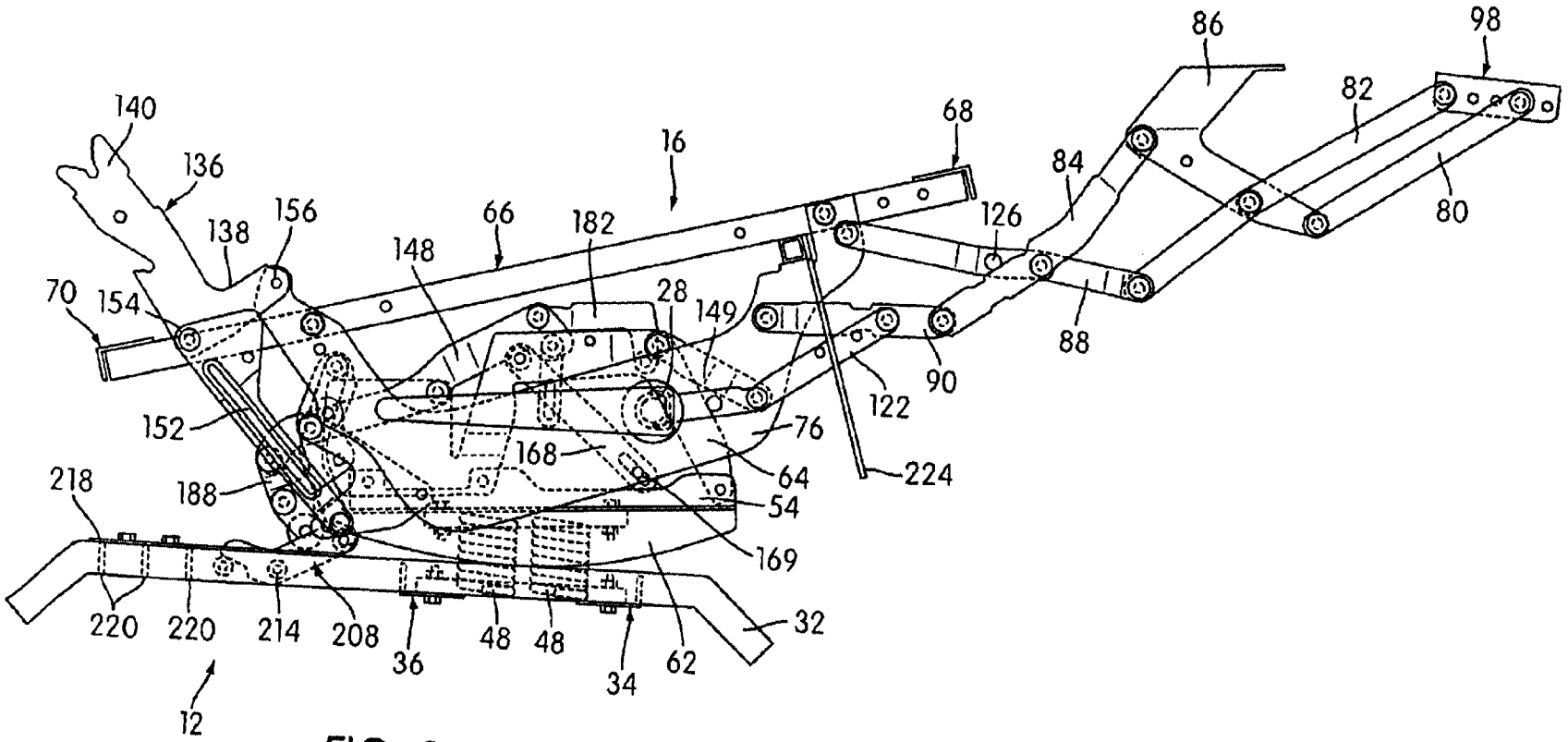
FIG. 9 is a comparable side elevational view of the mechanism in the position of FIG. 8, showing more of the mechanism.
Figure 10:
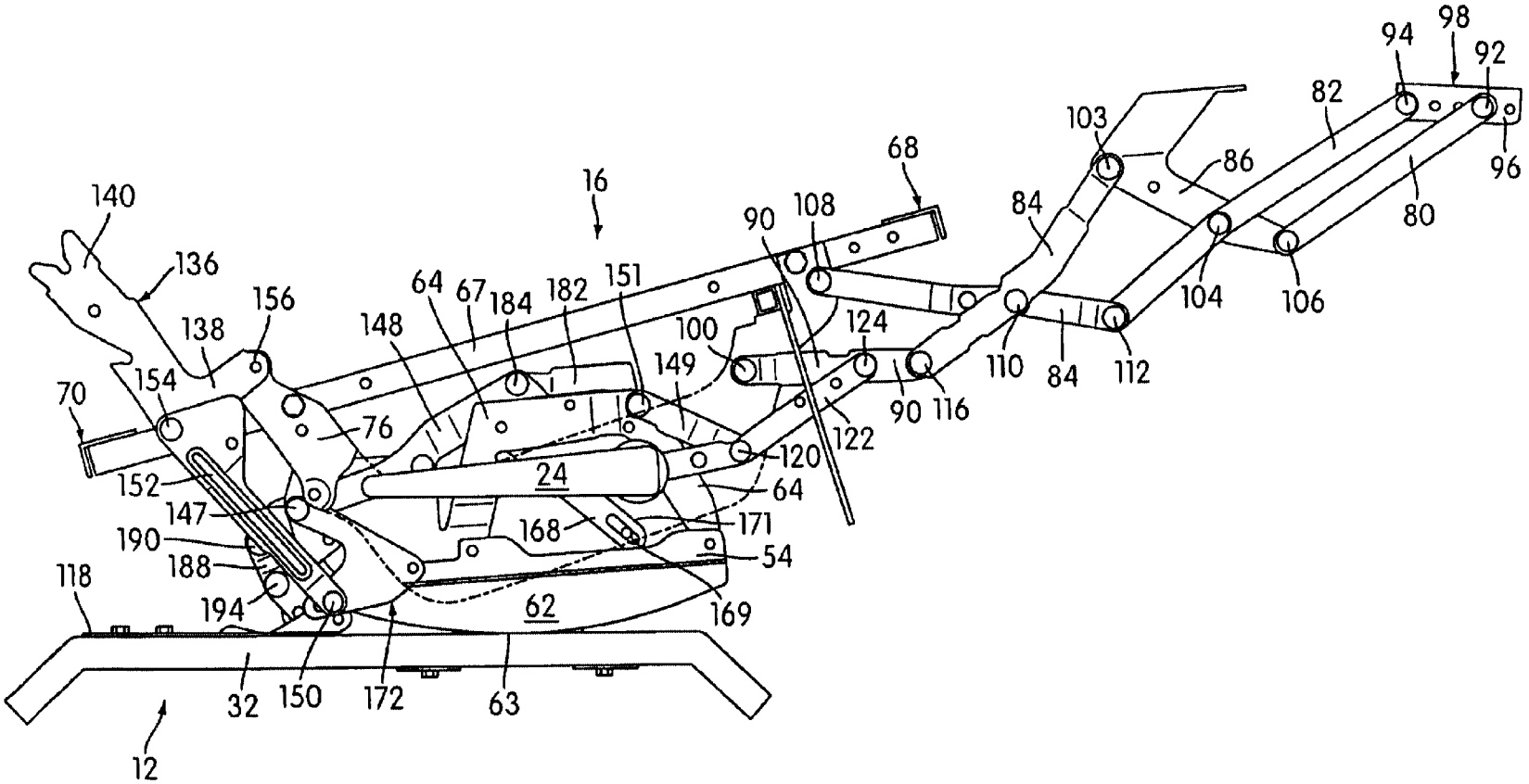
FIG. 10 is a comparable side elevational view of the mechanism in the position of FIG. 8, with the seat mounting plate partially cut away.
Figure 11:
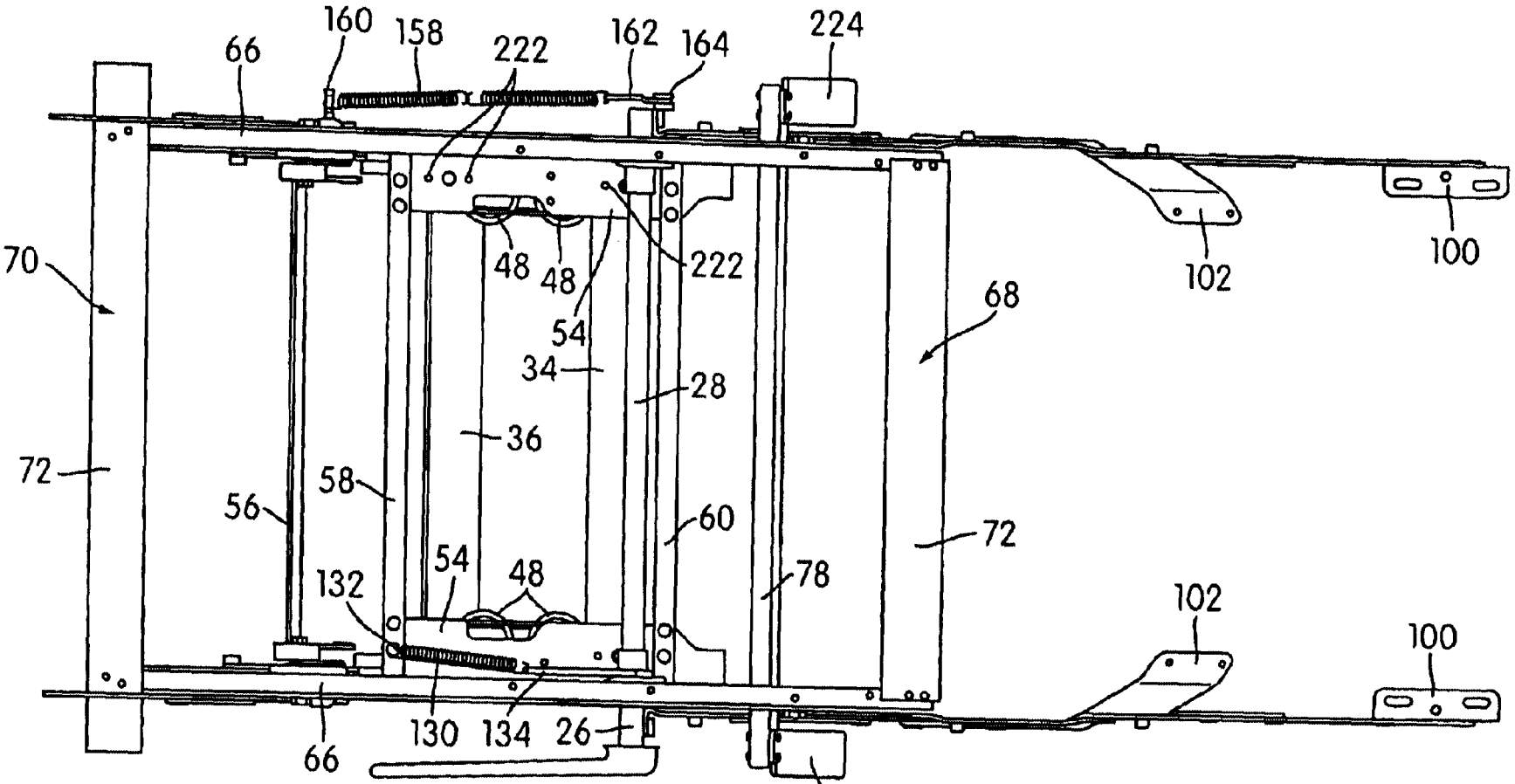
FIG. 11 is a top plan view of the mechanism, shown in the fully reclined position thereof.
Figure 12:
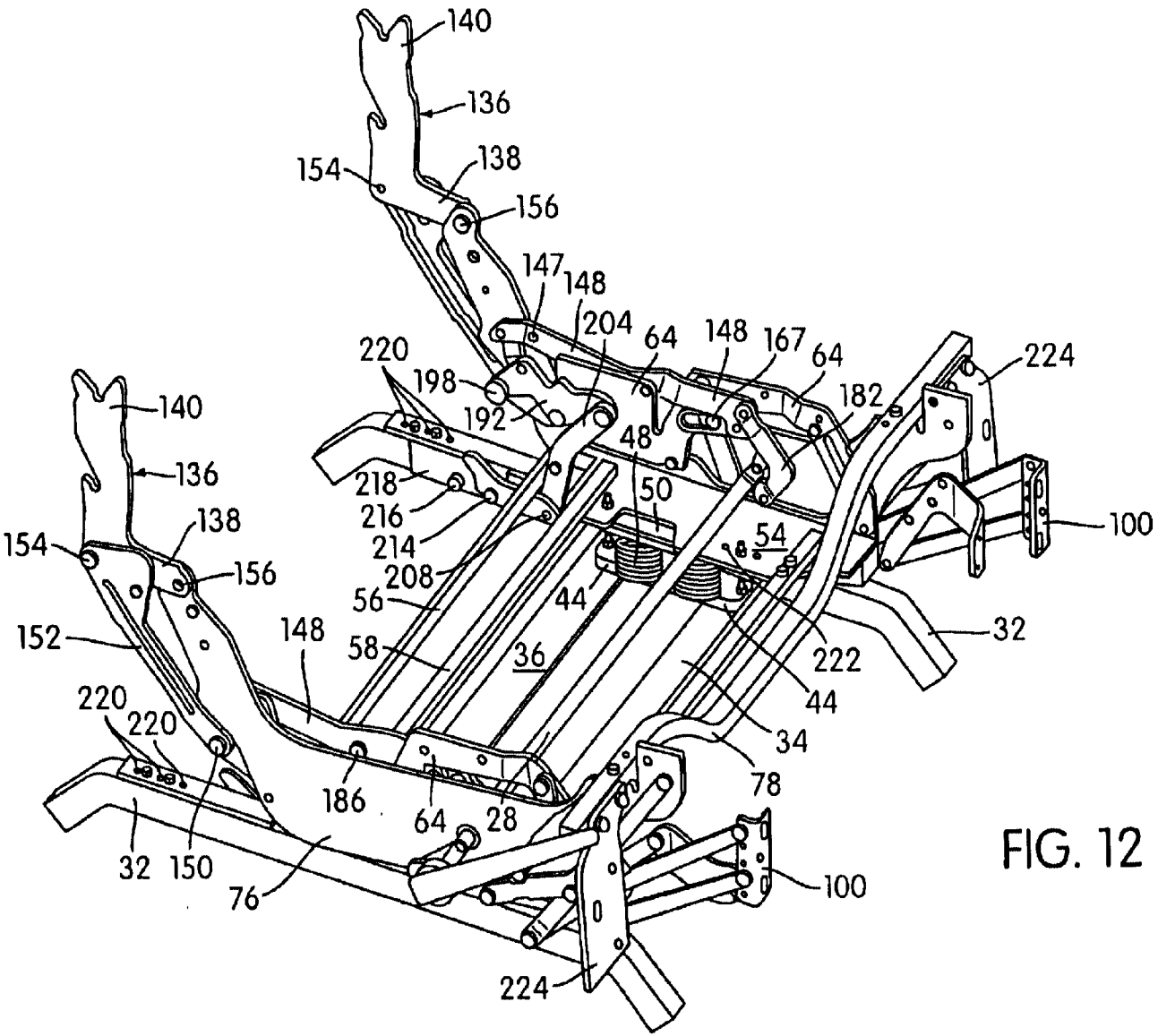
FIG. 12 is a perspective view of the mechanism from the right end above, shown in the upright position of FIG. 2.

Each side linkage further includes interpivoted links for causing the seat and arm frame unit and the pantograph linkage-supported ottoman and secondary ottoman to move forwardly and upwardly, as a whole, along an oblique-to-horizontal path as the chair back is caused to recline (by a user leaning back with emphasis on the upper part of the chair back 20 while seated in the chair, to move the chair from its FIG. 5 to FIG. 8 position, and for causing the reverse, as the person concentrates their weight downwards on the rear part of the upholstered seat of the upholstered seat and arm frame unit, while reducing backward pressure on the chair back, thereby moving the chair from its FIG. 8 fully reclined position, back to its FIG. 5 intermediate, TV position.

These interpivoted links, on each side linkage, are shown including an L-shaped chair back mounting link 136, having a forwardly projecting lower leg 138 and an upwardly projecting leg 140.

A V-shaped link 142 has an upper leg 144 and a lower leg 146. The upper end of the upper leg 144 is pivotally connected by a transverse, horizontal axis pivot joint 147 to a location on a longitudinal drive link 148. The rear end of the lower leg 146 is pivotally connected by a transverse, horizontal axis pivot joint 150, to the lower end of a connecting link 152, the upper, rear end of which is connected by a transverse, horizontal axis pivot joint 154 to a site at the lower, rear leg juncture (apex) of the L-shaped link 136. The apex of the V-shaped link 142 is pivotally connected to the seat mounting plate 76 by a pivot joint 151.

A swing link 149 is pivotally connected at its upper end by a transverse, horizontal axis pivot joint 151 to the support plate 64, and is pivotally connected at its lower end by a transverse, horizontal axis pivot joint 153 to the seat mounting plate 76.

The chair back 20, at its left and right sides, bolts to the legs 140 of the L-shaped links 136.

The forward end of the forwardly projecting lower leg 138 of each L-shaped link 136 is connected by a respective transverse, horizontal axis pivot joint 156 to an upwardly, rearwardly projecting tab at the upper rear of the seat mounting plate 76, above the member 66 of the bracket 16.

A coil spring 158, which elastically stretches as the chair is moved from its FIG. 5 to its FIG. 8 position, and recovers as the chair moves back to its FIG. 5 position, has its opposite ends hooked over laterally outwardly projecting pin 160 and eye 162, which is mounted on extension 164.

As the chair back is reclined, the seat and arm frame unit moves forward relative to the base, and the seating plane raises as the V-shaped links 142 pivot about horizontal axis pivot joints 147, and the swing links 149 pivot about pivot joints 151.

The trajectory of the bracket 16 upon movement from the TV position to the fully reclined position, and back, is constrained for each side linkage by the swing links 149 and engagement of the torque tube 28 with surfaces of the support plates 64 at the point of full recline. The support plates 64 thus act to limit the reclining motion of the chair 10 by blocking the torque tube 28 from further movement in the reclining direction.

Slotted biasing links 166 and 168 are provided on each side linkage. Shorter slotted link 166 has its upper end pivotally connected to the longitudinal drive link 148 by the pivot joint 170, and its lower slotted end is connected to an intermediate location on the longer slotted link 168 by a pin 172, which is received in the slot of the slotted link 166. The longer slotted link 168 has its upper end pivotally connected to the support plate 64 by the pivot joint 174 and its lower slotted end receives a pin 169 therein, with the pin 169 being mounted on the seat mounting plate 76.

A locking linkage is included to lock and prevent the chair 10 from rocking when the ottoman linkage is in the extended position, as in the TV position of FIG. 5 and the fully reclined position of FIG. 8. The locking linkage includes a crank link 178 fixedly attached to the torque tube 28 at one end, and at its radially outward end is pivotally connected by pivot joint 180 to an L-shaped link 182, which is in turn pivotally connected to the longitudinal drive link 148 at a forward end thereof by pivot joint 184.

The longitudinal drive link 148 is pivotally mounted, at an intermediate location thereof, on the support plate 64 by pivot joint 186. A rearward end of longitudinal drive link 148 is pivotally connected to a short connecting link 188 at an upper end thereof by pivot joint 190. The connecting link 188 is connected at a lower end thereof to a pivot link 192 by a pivot joint 194.

Figure 2:
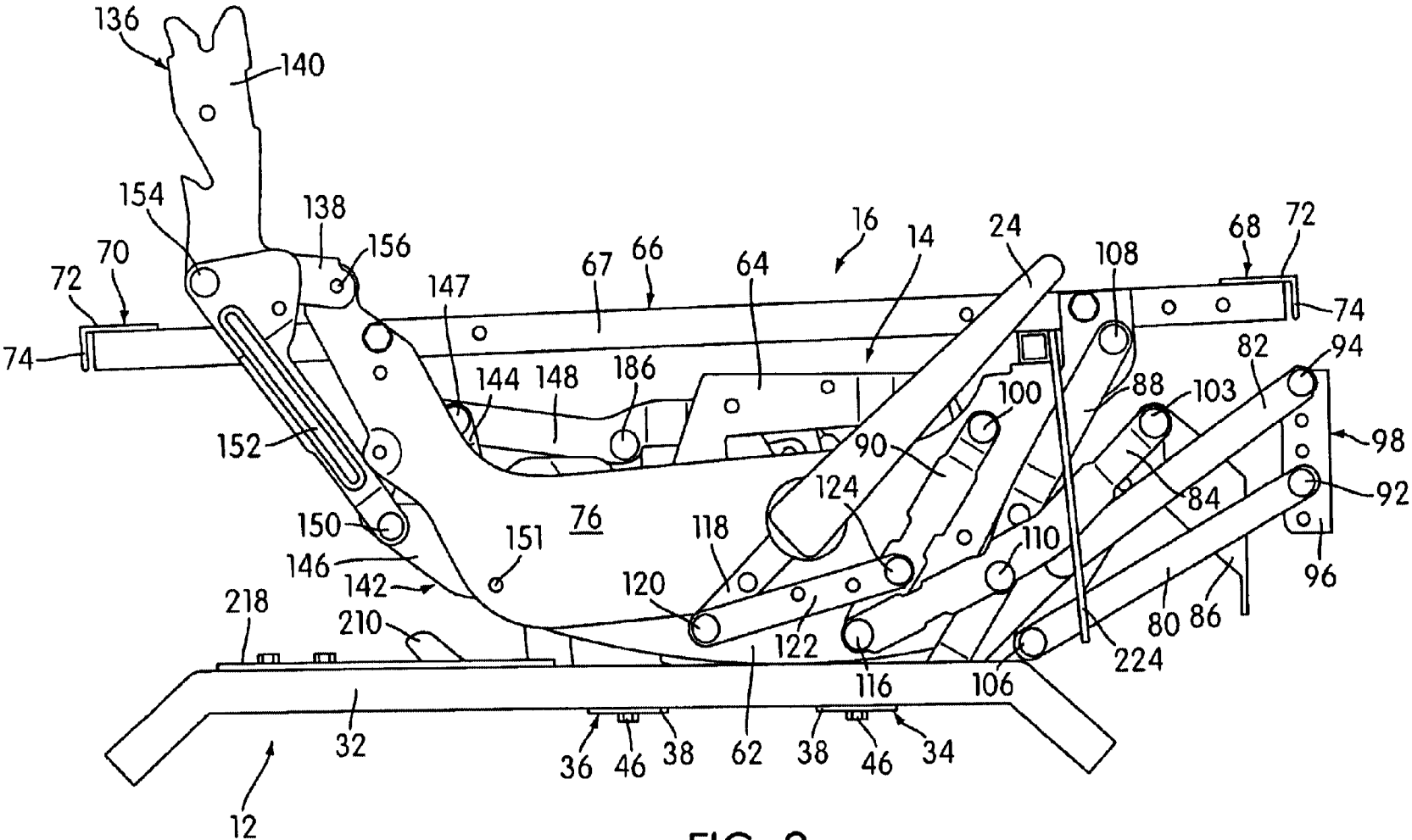
FIG. 2 is a side elevational view of the mechanism for the chair of FIG. 1 (right side linkage), shown in the upright position thereof.
Figure 3:
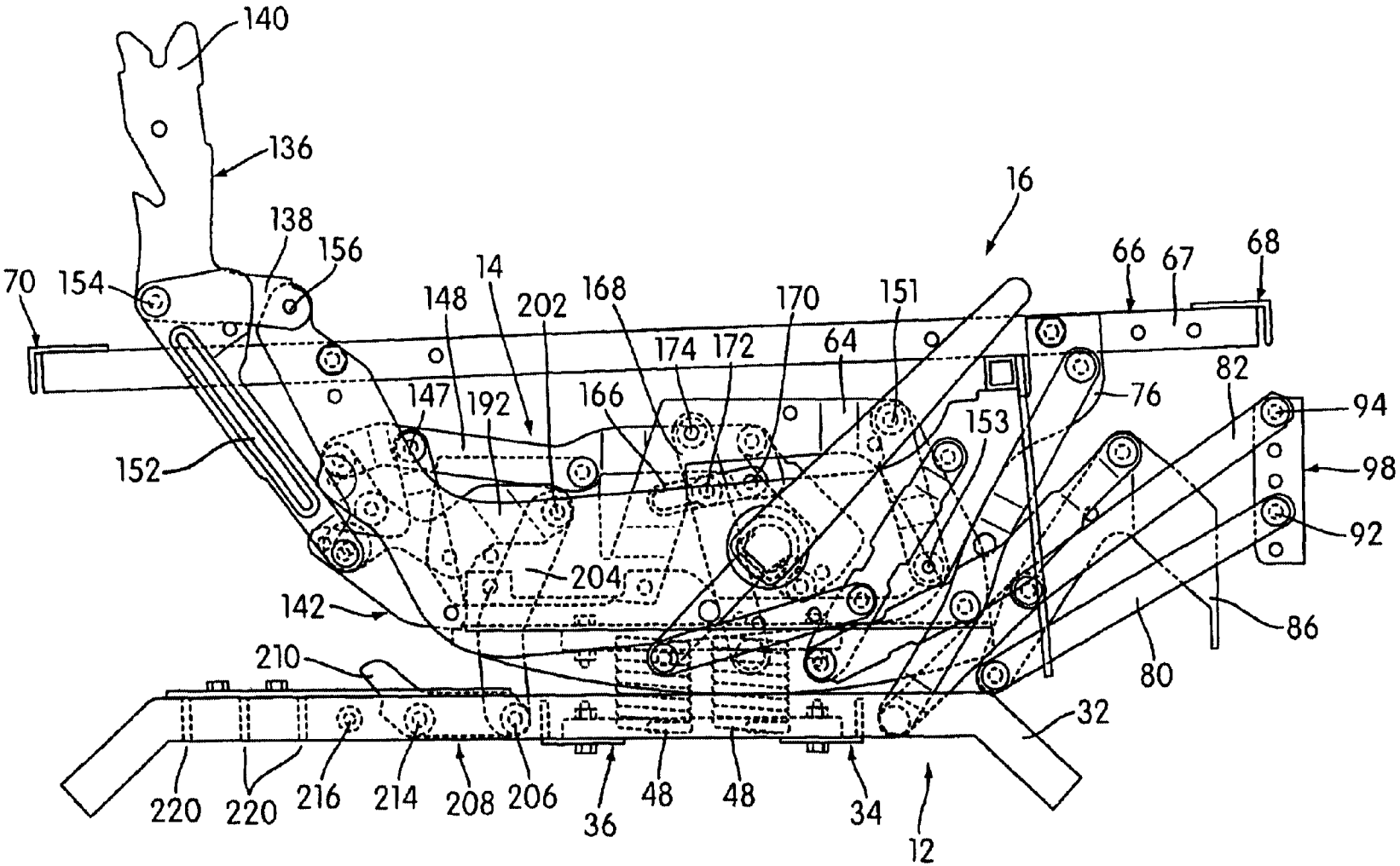
FIG. 3 is a comparable side elevational view of the mechanism in the position of FIG. 2 showing more of the mechanism.
Figure 4:
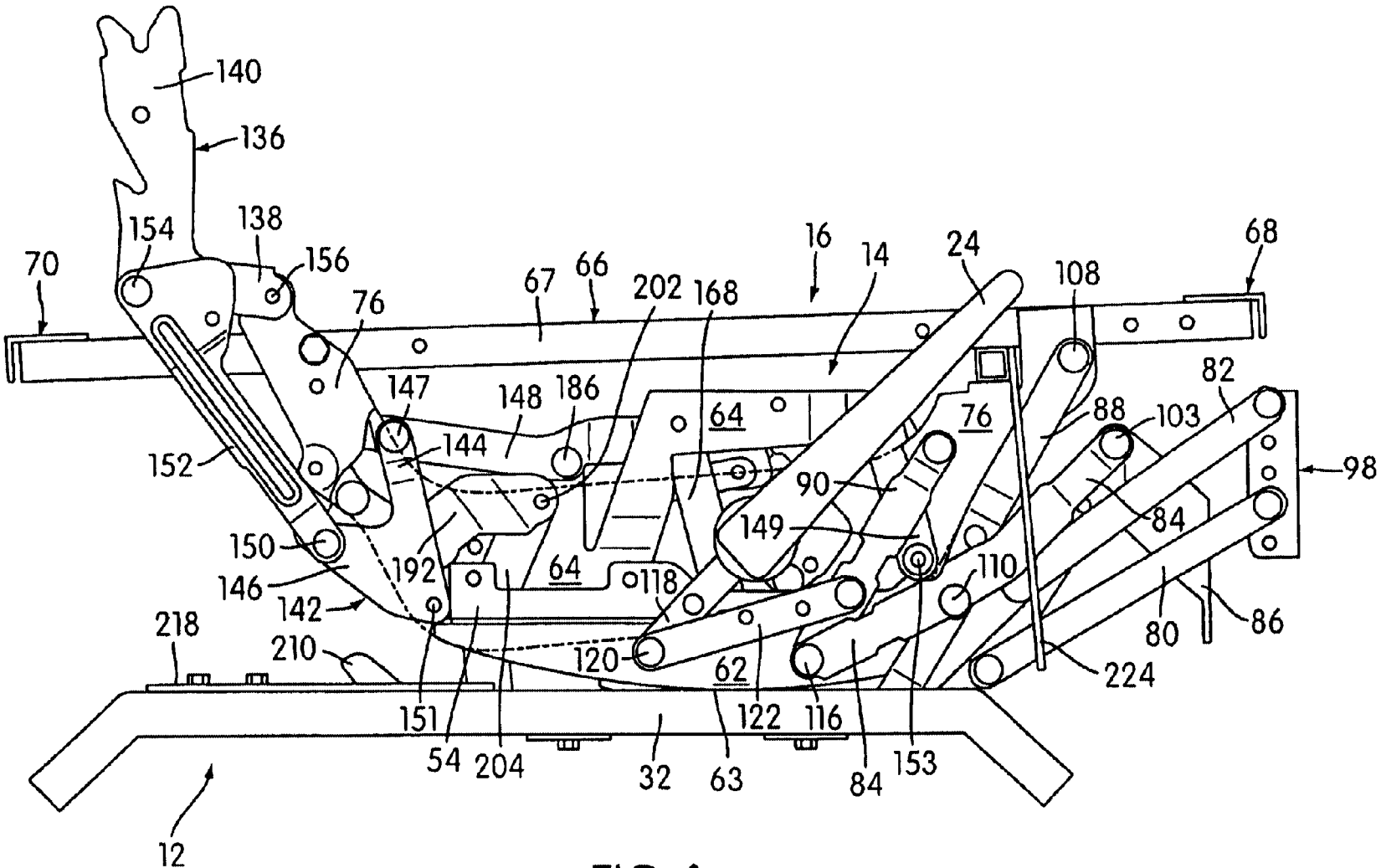
FIG. 4, is a comparable side elevational view of the mechanism of FIG. 2 with the seat mounting plate partially cut away.

The pivot link 192 is pivotally mounted on the support plate 64 by pivot joint 195 at an intermediate location on the pivot link 192. The pivot link 192 has a roller end 196, which when the chair 10 is in the upright position of FIG. 2, is oriented toward the rear of the chair 10. A lock roller 198 is mounted on the roller end 196 of the pivot link 192.

The pivot link 192 has an opposed end 200, which when the chair 10 is in the upright position of FIG. 2, it is oriented forward of the roller end 196. As will be described presently in more detail, when the locking linkage is actuated by rearward rotation of the handle 24 (resulting in rearward rotation of the torque tube 28), the pivot link 192 pivots about the pivot joint 195 to move the roller end 196 into a downwardly oriented position to bring the lock roller 198 into a locking position, and to bring the opposed end 200 to an upwardly oriented position for further locking action as described below.

The opposed end 200 is pivotally connected by pivot joint 202 to an upper end of a lock drive link 204. At a lower end thereof, the lock drive link 204 is pivotally connected by pivot joint 206 to a forward end of a locking link 208. A rearward locking end 210 of the locking link 208 has a generally duck bill-shaped locking profile 212 formed thereon, and is pivotally mounted on the longitudinal base member 30 tube by pivot joint 214. A stop pin 216 is mounted to project inboard of the longitudinal base member 32 at a location rearward of the pivot joint 214.

A locking plate 218, preferably fabricated from steel, is mounted on the rearward portion of the longitudinal base member 32 on the top and inboard surface thereof. The stop pin 216 is preferably mounted on the inboard surface of the locking plate 218.

In the upright position of the chair 10, the locking link 208 is oriented so that the locking end 210 and its generally duck bill-shaped locking profile 212 are spaced from the stop pin 216. However, when the handle 24 is rotated rearwardly, the torque tube 28 rotates in the same direction to drive the locking linkage so as to pivotally rotate the pivot link 192, which, as described above, brings the lock roller 198 in contact with the top surface of the locking plate 218. Rearward movement of the handle 24 also results in movement of the opposed end 200 of the pivot link 192 to an upwardly oriented position and as a result moves the lock drive link 204 upwardly, thereby pivotally rotating the locking link 208 so as to move the locking end 210 thereof downwardly, bringing the locking profile 212 of the locking end 210 into locking contact with the stop pin 216.

In this way, the lock roller 198 and the locking end 210 of the locking link 208 of the preferred embodiment are brought into locking engagement with, respectively, the top surface of the locking plate 218 and the stop pin 216, thereby securely locking the chair 10 from rocking movement. This double-locking action is advantageous to prevent rocking movement of the chair 10 when the ottoman linkage is in the extended position of FIGS. 5 and 8, since such rocking movement could result in instability of the chair and discomfort to the user. The locking end 210 of the locking link 208, the stop pin 216, and the lock roller 198 are all located rearward of the location where the rocker cam 62 bears on the top surface of the longitudinal base member 32. The locking link 208 and lock roller 198 are located relatively close to each other which enables the locking linkage to be of relatively simple construction for easy fabrication and ease of operation.

Figure 13:
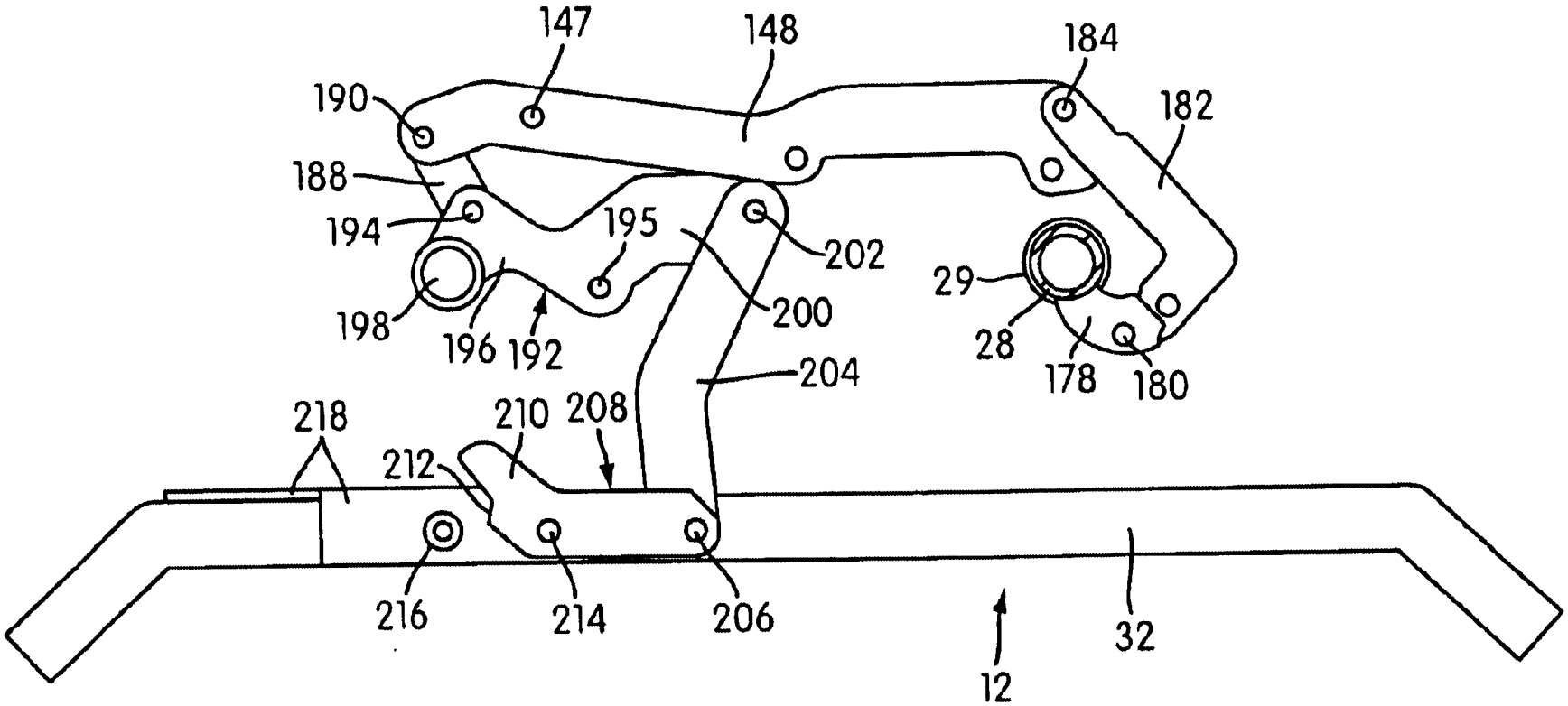
FIG. 13 is a diagrammatic fragmentary view of a portion of the locking linkage of the mechanism, shown in the upright position of FIG. 2.
Figure 14:
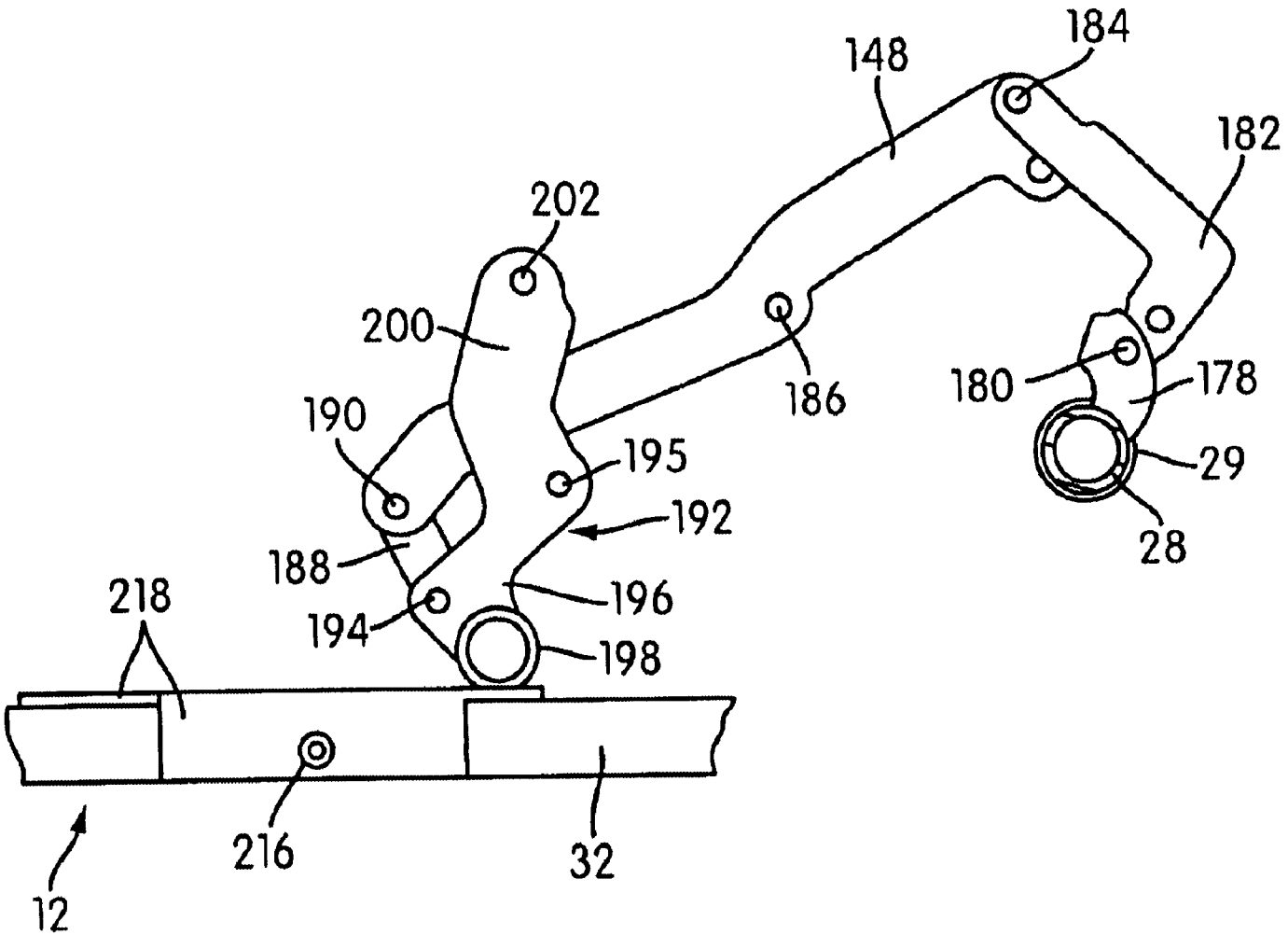
FIG. 14 is a diagrammatic fragmentary view of a portion of the locking linkage of FIG. 13 with the chair in the TV position of FIG. 5.
Figure 15:
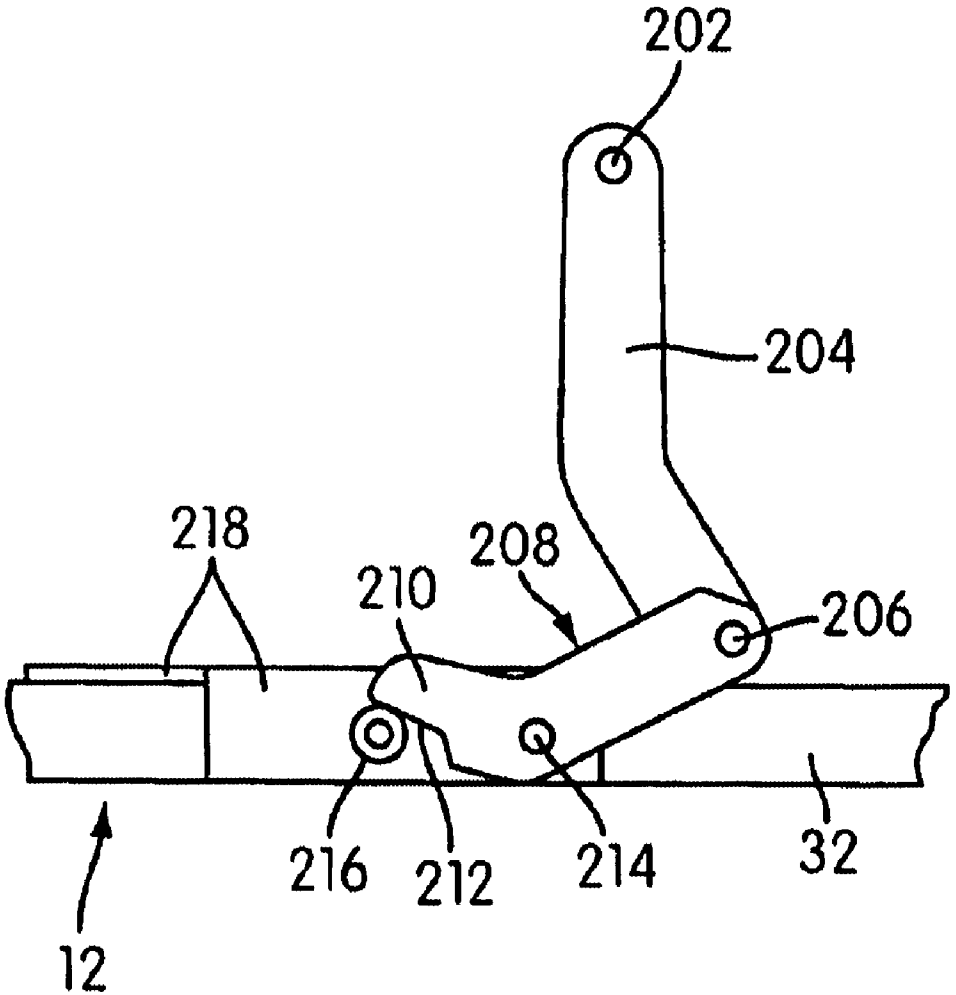
FIG. 15 is diagrammatic fragmentary view of another portion of the locking linkage of FIG. 13 with the chair in the TV position of FIG. 5.

The locking linkage is diagrammatically depicted in FIGS. 13–15, with FIG. 13 illustrating the locking linkage with the chair in the upright position of FIG. 2. The longitudinal drive link 148 is in a generally horizontal disposition, and the pivot link 192 is also in a generally horizontal position along its major axis.

FIG. 14 diagrammatically depicts a portion of the locking linkage with the chair in the TV position of FIG. 5, showing the longitudinal member 148 pivoted with its rearward end in a lower disposition as a result of the torque tube 28 having rotated rearwardly (through movement of the handle 24). In this position the pivot link 192 is pivoted so that its major axis is in a generally vertical disposition, resulting in the lock roller 198 contacting the lock plate 218 for locking engagement. The lock drive line 204 and the locking link 208 are omitted from FIG. 14 for clarity.

FIG. 15 diagrammatically depicts the lock drive link 204 and the locking link 208 as they are oriented with the chair in the TV position (other elements of the locking linkage are omitted for clarity). The locking link 208 is pivoted rearwardly to bring the duckbill-shaped locking profile 212 of the locking end 210 into locking engagement with the stop pin 216.

Engagement of the locking linkage by rotation of the handle 24 rearwardly also produces tilting of the rocker cam 62 to the rear, thereby providing the chair with a greater pitch when the ottoman pantograph linkage is extended. The double-locking action of the locking linkage provides secure locking of the chair 10 to prevent undesired rocking movement, despite the increased pitch.

The locking plate 218 is mounted to the longitudinal base member 32 by nut-and-bolt sets placed in appropriate through-holes. The longitudinal base member 32 and the locking plate 218 are preferably provided with additional through-holes 220, so that the locking plate can be adjustably positioned to accommodate different chair mechanisms which may have different locking linkages. The cam mounting plate 54 is also provided with additional through holes 222 so that the cam mounting plate 54 (and the support plate 64 mounted thereon) can be adjustably positioned on the rocker cam 62. In this way, different chairs, which may have different weight characteristics (e.g., heavier or lighter backs, heavier or lighter arm portions, etc.) can be accommodated by adjustably positioning the cam mounting plate 54 in an advantageous position so that the chair is appropriately balanced for efficient operation.

The slotted links 166 and 168 cooperate to bias the mechanism so as to prevent creaking and other undesired movement from the locking linkage when the chair is in the upright position of FIG. 2. In the upright position, the slotted link 166 biases the longitudinal drive link 148 forwardly through their interconnection by the pivot link 170. In the upright position, the slotted link 168 biases the seat mounting plate 76 downwardly, via the pin 169. The slotted link 166 also acts, through its connection with the longitudinal drive link 148, to guide the longitudinal link 148 in its movement as the chair moves among the upright position, the TV position of FIG. 5, and the fully reclined position of FIG. 8.

In use the chair 10 may be rocked by the user when the chair is in its FIG. 2 upright position, with the biasing of slotted links, 166, 168 reducing creaking of the locking linkage during rocking motion. The user may then extend the ottoman pantograph linkage by rotating the handle 24 rearwardly to cause the chair 10 to assume the TV position of FIG. 5. The locking linkage will be engaged through rearward movement of the handle 24 to position the lock roller 198 and the locking end 210 of the locking link 208 in their locking positions to prevent rocking movement. In the TV position the chair 10 is tilted rearwardly on the rocker cam 62 to assume a position of enhanced comfort while remaining stable. The user can then recline the chair back 20 to cause the chair 10 to assume its fully reclined position of FIG. 8 to further enhance comfort.

The upholstered seat and arm frame unit can be provided with a wide range of styles. In the preferred embodiment, it bolts to a front and rear transverse members 68, 70 of the mounting bracket 16, and to laterally outwardly projecting depending flanges 224 which are bolted to cantilevered outrigger stubs of the transverse member 78.

The mechanism for the chair 10 is preferably made of conventional materials, e.g., steel plate, punched, bent, bored and painted flat black; steel pins; self-lubricated plastic washer-like bushings for joints, steel rivet-type pivot joints, attention being given to thickness and strength, given that the chair 10 preferably is made for use by especially tall and heavy users.

However, the mechanism and/or its components could be provided on motion chairs intended for use by average-sized persons as well.

The principles of the invention have been shown and explained in relation to a free-standing, single seat rocking chair having two arms. However, the principles of the invention can be applied to motion seating furniture in which the upholstered seat and arm frame is one-armed (as in a recliner unit for an armed end of a multiple seat sectional sofa), or is replaced by an armless upholstered seat frame (as in a recliner unit for an armless end of a multiple seat sectional sofa).

It should now be apparent that the rocking reclining chair and mechanism therefor as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A recliner mechanism for a rocker chair, comprising:

abase;

a backrest;

an ottoman;

left and right rocker cam assemblies each including a rocker cam positioned at a cam bearing location relative to said base for forward and rearward rocking motion;

left and right side linkages, each including:

a seat mounting surface being connected to one of said rocker cam assemblies through lint an ottoman linkage driven by a handle-operated torque tube to move said ottoman between an extended position and a retracted position;

said handle-operated torque tube being connected to interpivoted crank and driving links for driving said ottoman linkages to extend said ottoman to the extended position and to retract said ottoman to the refracted position; and a rocker locking assembly driven by said torque tube to lock said rocker cams against rocking motion when said ottoman is in the extended position, said rocker locking assembly including two locking elements ranged on each of left and right sides of the locking assembly to engage the base for locking engagement at locking locations rearward of the cam bearing locations.

2. The mechanism of claim 1, wherein said rocker locking assembly includes a pivot link mounted on one of said rocker cam assemblies for pivotal movement between a non-locking position and a locking position in which said pivot link drives said locking members for locking engagement with said base.

3. The mechanism of claim 2, wherein:

said pivot link has roller end having a lock roller mounted thereon and an opposed end pivotally collected to a lock member for engaging a stop pin on said base.

4. The mechanism of claim 3, wherein:

said base further includes a locking plate having a locking surface for locking engagement by said lock roller.

5. The mechanism of claim 1, wherein:

said rocker cams are inclined rearwardly when said rocker locking assembly is driven to lock said rocker cams.

6. The mechanism of claim 1, wherein:

said base includes a locking plate having a looking surface for engagement by one of said lock members and a stop pin for locking engagement by the other of said lock members.

7. The mechanism of claim 6, wherein:

said locking plate is adjustably mounted on said base for adjustable movement thereon.

8. The mechanism of claim 1, wherein:

said rocker cam assemblies each include a mounting member mounted on said rocker cam for supporting the upholstered seat frame, said mounting member being adjustably mounted on said rocker cam.

9. The mechanism of claim 1, wherein:

said rocker locking assembly includes a biasing member for biasing said rocker locking assembly against movement when said ottoman is in the retracted position.

10. The mechanism of claim 9, wherein:

each said side linkage further includes a second biasing member.

11. A mechanism for a rocking reclining chair which includes an upholstered seat frame, an upholstered back, and an ottoman, comprising:

a base arranged to be supported on a floor;

left and right side linkages each including:

a set of pantographically interpivoted links for mounting the ottoman for extension to an extended position and retraction to a refracted position;

a rocker cam assembly for supporting the upholstered seat frame relative to the base and including a rocker cam positioned at a cam bearing location relative to said base floor forward and rearward rocking motion; and a set of interpivoted support links for supporting the upholstered back for movement between mote erect position achievable when the ottoman is in the retracted or extended position, and a more recumbent position achievable when the ottoman is in the extended position;

a plurality of transverse members fixedly interconnecting said left and right side linkages;

a transversely extending torque tube journaled in said left and right side linkages for reversible rotation about its own longitudinal axis;

interpivoted crank and driving links operatively connecting said torque tube with said pantographically interpivoted links, for extending the ottoman upon rotation of the torque tube in one angular direction and for retracting the ottoman upon rotation of the torque tube in an opposite angular direction; and left and right locking linkages operatively connected to said torque rube, each of said linkage including a pair of locking members for locking engagement with said base hen the ottoman is in the extended position, each of said pairs of locking members engaging said base rearward of the cam bearing locations.

12. The mechanism of claim 11, wherein:

each said side linkage includes a pivot link mounted on one of said rocker cam assemblies for pivotal movement between a non-locking position and a locking position in which said pivot link drives said locking members for locking engagement with said base.

13. The mechanism of claim 12, wherein:

said pivot links each have a roller end having a lock roller mounted thereon and an opposed end pivotally connected to a lock member for engaging a stop pin on said base.

14. The mechanism of claim 13, wherein:

said base further includes a locking plate having a locking surface for locking engagement by said lock rollers.

15. The mechanism of claim 11, wherein:

said rocker cams are inclined rearwardly when said rocker locking assembly is driven to lock said rocker cams.

16. The mechanism of claim 11, wherein:

said base includes a locking plate having a locking surface for engagement by ones of said locking members and a stop pin for locking engagement by the others of said locking members.

17. The mechanism of claim 16, wherein:

said locking plate is adjustably mounted on said base for adjustable movement thereon.

18. The mechanism of claim 11, wherein:

said rocker cam assemblies each include a mounting member mounted on said rocker cam for supporting the upholstered seat frame, said mounting member being adjustably mounted on said rocker cam.

19. The mechanism of claim 11, wherein:

each said side linkage includes a biasing member for biasing said rocker locking assembly against movement when the ottoman is in the retracted position.

20. The mechanism of claim 19, wherein:

each side linkage further includes a second biasing member.

21. A rocking reclining chair, comprising:

an upholstered seat frame;

an upholstered back;

an ottoman;

a base arranged to be supported on a floor;

a mechanism including:

left and right side linkages each including:

a set of pantographically interpivoted links mounting the ottoman for extension to an extended position and retraction to a retracted position;

a rocker cam assembly for supporting the upholstered seat frame relative to the base, said rocker cam assembly including a rocker cam positioned at a cam bearing location relative said base for forward and rearward rocking motion and a support member adjustably mounted to said rocker cam; and a set of interpivoted support links supporting the upholstered back for movement between a more erect position achievable when the ottoman is in the retracted or extended position, and more recumbent position which is achievable when the ottoman is in the extended position;

a plurality of transverse members fixedly interconnecting said left and right side linkages;

a transversely extends torque tube journaled in said left and right side linkages for reversible rotation about its own longitudinal axis;

interpivoted crank and driving links operatively connecting said torque tube with said pantographically interpivoted links, for extending the ottoman upon rotation of the torque tube in one angular direction and for retracting the ottoman upon rotation of the torque tube in an opposite annular direction;

left and right locking linkages operatively connected to said torque tube, each locking linkage including a lock roller and a locking link for locking engagement with said base when said ottoman is in the extended position, each of said lock rollers and locking links engaging said base rearward of the cam bearing locations, raid locking linkage driving said rocker cams to be tilted rearwardly a predetermined amount when said ottoman is in the extended position;

each of said said locking linkages further including a pivoting drive link pivotally mounted on one of said support members for pivotal movement between a rocking position and a locking position, said pivoting drive link having a rearward end having pivotal connection to a pivoting link member, said pivoting link member having a lock roller end on which std lock roller is mounted and a second end having pivotal connection to said locking link, said pivoting link being pivotally mounted on said one of said support members for pivotal movement between a rocking position and a locking position.

* * * * *